US011054790B2

(12) United States Patent
Bazin et al.

(10) Patent No.: US 11,054,790 B2
(45) Date of Patent: Jul. 6, 2021

(54) METHOD FOR CUTTING WATCH CRYSTALS

(71) Applicant: The Swatch Group Research and Development Ltd, Marin (CH)

(72) Inventors: Jean-Luc Bazin, Tuescherz-Alfermee (CH); Martin Gunn-Sechehaye, Biel/Bienne (CH)

(73) Assignee: The Swatch Group Research and Development Ltd, Marin (CH)

( * ) Notice: Subject to any disclaimer, the term of this patent is extended or adjusted under 35 U.S.C. 154(b) by 417 days.

(21) Appl. No.: 16/104,238

(22) Filed: Aug. 17, 2018

(65) Prior Publication Data

US 2019/0113890 A1 Apr. 18, 2019

(30) Foreign Application Priority Data

Oct. 16, 2017 (EP) ..... 17196547

(51) Int. Cl.
*G04D 3/06* (2006.01)
*G04D 3/00* (2006.01)
(Continued)

(52) U.S. Cl.
CPC ..... *G04D 3/065* (2013.01); *B24B 9/085* (2013.01); *B24B 19/03* (2013.01); *G04B 39/002* (2013.01);
(Continued)

(58) Field of Classification Search
CPC ..... B24B 19/03; B24B 9/085; G04D 3/065; G04D 3/06; G04B 39/006; G04B 39/002; G04B 39/004
(Continued)

(56) References Cited

U.S. PATENT DOCUMENTS 2,140,410 A * 12/1938 Titmus ..... B24B 13/00 351/159.74
2,372,215 A * 3/1945 McCormick, Jr. ..... C03B 33/09 225/2
(Continued)

FOREIGN PATENT DOCUMENTS

JP 55-051385 4/1980
JP 59-178385 10/1984
(Continued)

OTHER PUBLICATIONS

European Search Report dated Apr. 13, 2018 in European Application 17196547.8 filed on Oct. 16, 2017 (with English Translation of Categories of Cited Documents).

*Primary Examiner* — Brian D Keller
*Assistant Examiner* — Jonathan G Santiago Martinez
(74) *Attorney, Agent, or Firm* — Oblon, McClelland, Maier & Neustadt, L.L.P.

(57) ABSTRACT

A method for cutting watch crystals along a plurality of contours in a plate of transparent material includes forming a first cut line or kerf to form a first chamfer for each of the crystals of the plate and marking at least one machined recess on a first side of the plate, turning the plate over and marking at least one of the position of the first chamfer and the position of the at least one machined recess, forming a second cut line or kerf to form a second chamfer for each of the crystals on a second side of the plate, and separating the crystals by machining through the plate at each of the contours to form edges of the crystals.

13 Claims, 2 Drawing Sheets

(51) Int. Cl.
*G04B 39/00* (2006.01)
*B24B 9/08* (2006.01)
*B24B 19/03* (2006.01)

(52) U.S. Cl.
CPC ..... *G04B 39/004* (2013.01); *G04D 3/0061* (2013.01); *G04D 3/06* (2013.01); *G04B 39/006* (2013.01)

(58) Field of Classification Search
USPC ..... 451/41, 57, 58
See application file for complete search history.

(56) References Cited

U.S. PATENT DOCUMENTS

| | | | | | |
|---|---|---|---|---|---|
| 2,508,017 | A * | 5/1950 | Echter | C03B 33/04 | 225/2 |
| 3,005,391 | A * | 10/1961 | Ragan | G03B 27/323 | 396/316 |
| 3,568,377 | A * | 3/1971 | Robert | B24B 55/02 | 451/444 |
| 7,371,431 | B2 | 5/2008 | Dietz et al. | | |
| 9,346,130 | B2 * | 5/2016 | Lei | C03B 33/0222 | |
| 2003/0148057 | A1 * | 8/2003 | Dietz | C03B 33/091 | 428/43 |
| 2016/0009587 | A1 * | 1/2016 | Saito | B23K 26/50 | 65/29.18 |

FOREIGN PATENT DOCUMENTS

| | | | | |
|---|---|---|---|---|
| JP | 62-070241 | | 3/1987 | |
| JP | S6270241 | A * | 3/1987 | G04B 39/00 |
| JP | 2001062669 | A * | 3/2001 | |

* cited by examiner

METHOD FOR CUTTING WATCH CRYSTALS

This application claims priority from European Patent Application No. 17196547.8 filed on Oct. 16, 2017; the entire disclosure of which is incorporated herein by reference

FIELD OF THE INVENTION

The invention concerns a method for cutting watch crystals along a contour in a plate of transparent material.

The invention concerns the field of watch crystals, more particularly made of hard material, such as sapphire, mineral glass or suchlike.

BACKGROUND OF THE INVENTION

The manufacture of transparent timepiece components, and particularly front or back cover crystals, generally requires machining chamfers front and back on either side of an assembly edge, which are important especially for facilitating a press fit, for ensuring sealing, and for aesthetics. The handling of such components during their machining cycle is difficult, requiring precautions to prevent any scratching due to burrs or to machining waste from the material of the crystal and/or the tools used to manufacture said crystal, or due to handling.

SUMMARY OF THE INVENTION

The invention proposes to develop a method allowing to chamfer and cut crystals at high speed, especially circular crystals, from large plates of transparent material.

To this end, the invention concerns a method according to claim 1.

BRIEF DESCRIPTION OF THE DRAWINGS

Other features and advantages of the invention will appear upon reading the following detailed description, with reference to the annexed drawings, in which:

FIG. 2 illustrates a first step of chamfering a first side.

FIG. 3 illustrates a third step of chamfering a second, opposite side, which follows a second step of turning the plate over (not illustrated), and placing the first, already machined side, onto an ad hoc tool.

FIG. 4 illustrates a fourth step of cutting and separating the finished crystals.

FIG. 5, with a tilting grinding wheel which moves along the contour to be machined with the tool shaft tilted for four-axis machining, this travel being illustrated in FIG. 6, which is a perspective diagram showing the tilt changes of said shaft;

FIG. 7, for the particular case of a circular crystal, by face plunge grinding with a grinding wheel whose dimensions match the profile of the crystal.

FIG. 8 with a single shank boring type tool, which moves along the contour of the crystal.

DETAILED DESCRIPTION OF PREFERRED EMBODIMENTS

Figure 1:
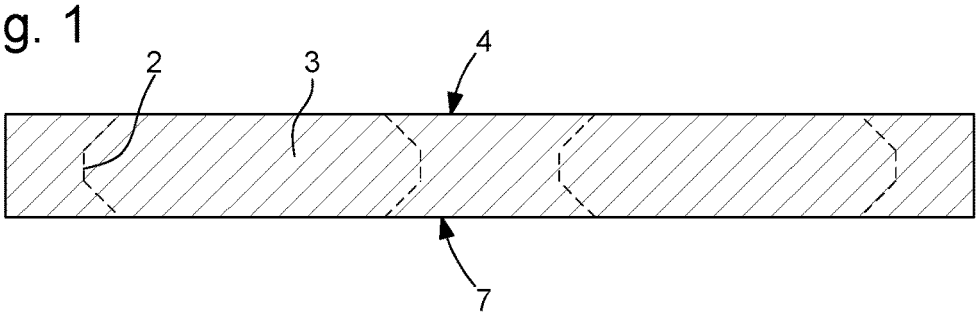
FIGS. 1 to 4 represent schematic cross-sections of the operations performed on a plate of transparent material represented in FIG. 1, with the profile of each crystal to be realized shown in dotted lines.
Figure 2:
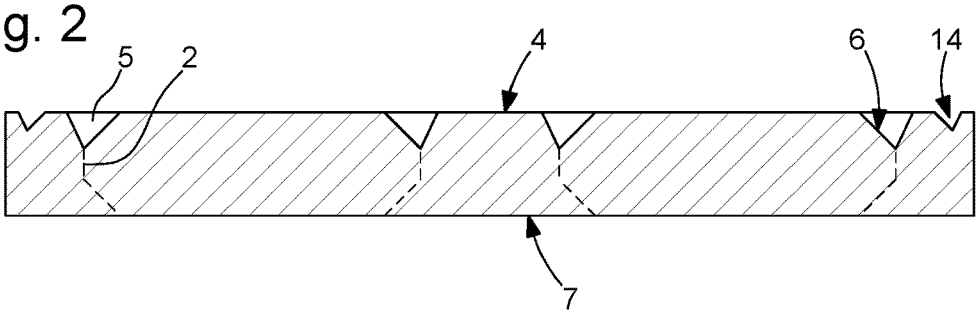
Figure 3:
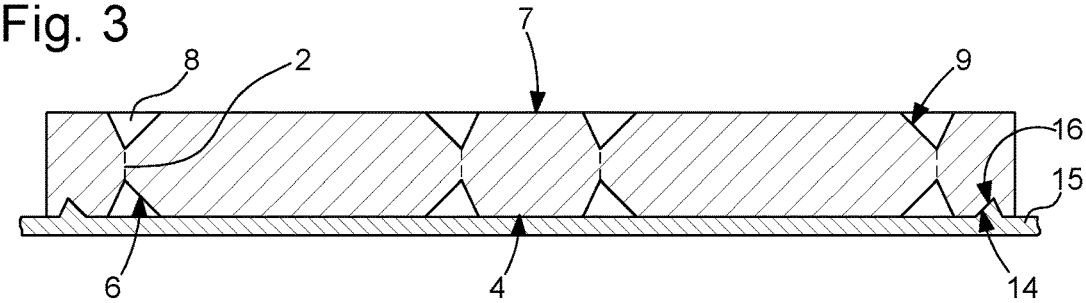
Figure 4:
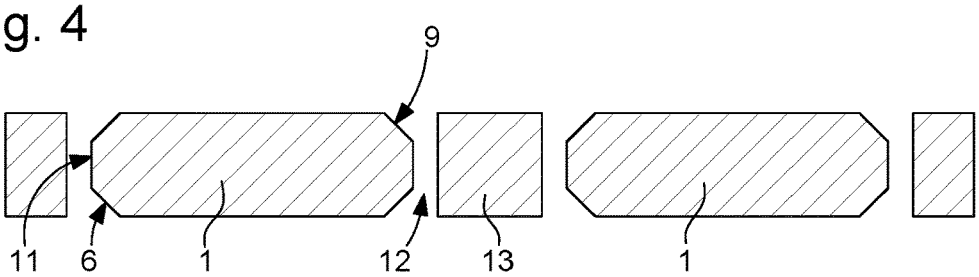
Figure 5:
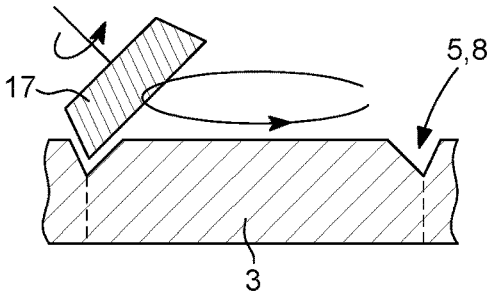
FIGS. 5, 7 and 8 represent schematic, partial cross-sections of the chamfering operations.
Figure 6:
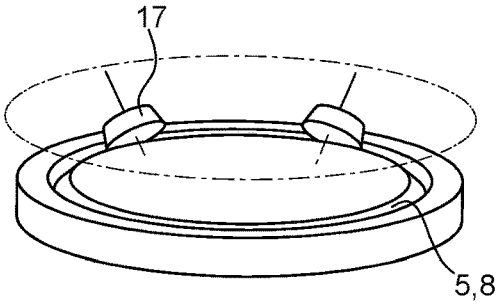
Figure 7:
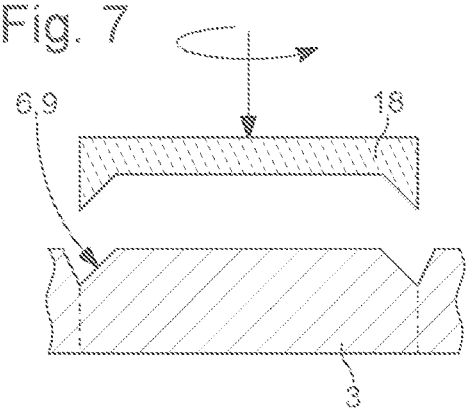
Figure 8:
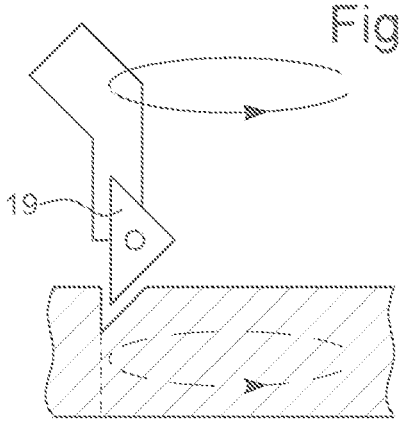

The invention concerns a method for cutting a timepiece crystal 1 along a contour 2 in a plate 3 of transparent material.

This transparent material is more particularly a hard material such as sapphire, mineral glass, particularly silicate, or a similar material; it may also be a polymer, called 'organic glass', or suchlike, this material is suitable for manufacturing visible components and more particularly watch crystals or watch back cover crystals.

According to the invention, the following steps are performed in succession and in this order:

- first step 100: realizing, on a first side 4 of plate 3, a first cut line or kerf 5 on at least the inside of contour 2, to form a first chamfer 6, for each of crystals 1 to be made from plate 3;
- second step 200: turning over plate 3 and marking the position of first chamfers 6 and/or of at least one machined marking 14 made during first step 100 of forming first chamfers 6;
- third step 300: realizing on a second side 7 of plate 3, opposite to first side 4, a second cut line or kerf 8 on at least the inside of contour 2, to form a second chamfer 9, in alignment with each first cut line 5 and each first chamfer 6, for each of crystals 1 to be made from plate 3;
- fourth step 400: separating crystals 1 from a skeleton 13 of plate 3 by machining through plate 3 at each contour 2 of each crystal 1 to form an edge 11 of crystal 1.

In a particular embodiment, during first step 100 and/or third step 300, there is used a grinding wheel 18 or a bell tool whose profile corresponds to the chamfer to be formed, driven in rotation and plunged straight onto plate 3, if contour 2 is circular.

In a particular embodiment, suitable for any elliptical or similar crystal contour, during first step 100 and/or third step 300, there is used a grinding wheel 17 or a bell tool driven in rotation and effecting multi-axis contouring along contour 2, with the axis of rotation of the grinding wheel or of the bell tool moving through space perpendicularly to the plane locally tangent to the chamfer to be formed. This method can also be used to form chamfers on square or rectangular crystals, but then requires recesses to be provided for the tool around each corner, which may require optimised positioning of the crystals on plate 3, to avoid too much waste of material.

In another particular embodiment, if permitted by the material of plate 3, and particularly for organic materials, during first step 100 and/or third step 300, there is used a shank boring tool 19, mounted on a boring head driven in rotation and plunged straight into plate 3 when contour 2 is circular. In a variant, an end mill or side-and-face cutter can also be used.

Likewise, in another particular embodiment, depending on the material of plate 3, during first step 100 and/or third step 300, there is used a shank boring tool 19 driven in rotation and effecting multi-axis contouring along contour 2, with the axis of rotation of a bore head carrying the shank boring tool moving through space perpendicularly to the plane locally tangent to the chamfer to be formed.

Naturally, in variants in which a tool other than a grinding wheel is used, especially a shank boring tool or a mill, the active part of the tool concerned is preferably coated with a coating, especially with a diamond or similar coating, like those used in optics or in the spectacle industry.

Different tool or mill shapes can be used, depending on the shape of the contour to be chamfered: a continuous bell, discontinuous bell, tool with a single cutting edge such as a shank boring tool, or otherwise. The type of tool depends on the type of material to be chamfered, and may, in particular but not exclusively, be chosen from: diamond-coated, or boron nitride coated or otherwise, diamond mill or other.

In an advantageous variant, during first step 100, at least one machined marking 14 is made, and, during second turning-over step 200, plate 3 is placed on a tool 15 including at least one relief portion 16, which is arranged to cooperate with said at least one machined marking 14 to position plate 3 in a unique position, and plate 3 is immobilised on said tool 15 by clamping means and/or suction means and/or freeze clamping means.

In a variant, to ensure proper positioning of the plate when it is turned over, an optical alignment system can be implemented using optical means, such as a camera or suchlike, or otherwise. Holding can be achieved mechanically or using vacuum pressure.

Figure 9:
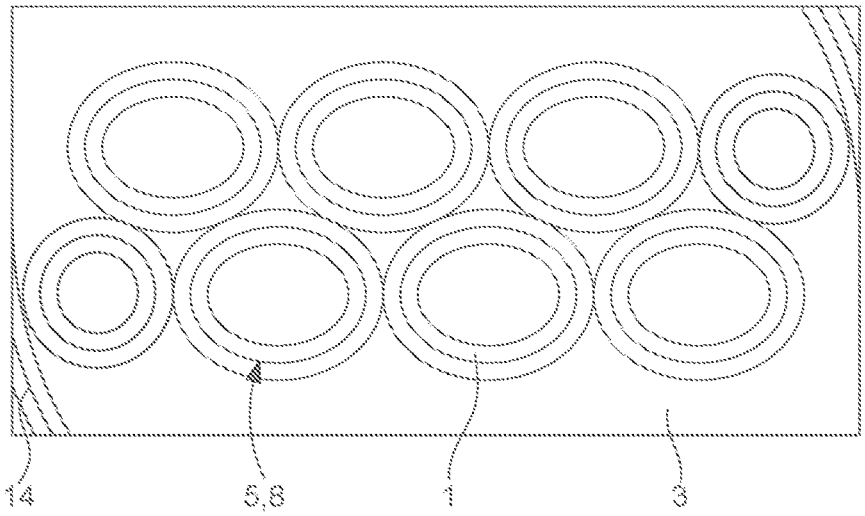
FIG. 9 represents a schematic top view, after the first chamfering step of FIG. 2, of a plate with chamfers corresponding to two different types of crystals—elliptical and circular—and including, in two opposite corners, machined markings for repositioning the plate on the tool of FIG. 3.
Figure 10:
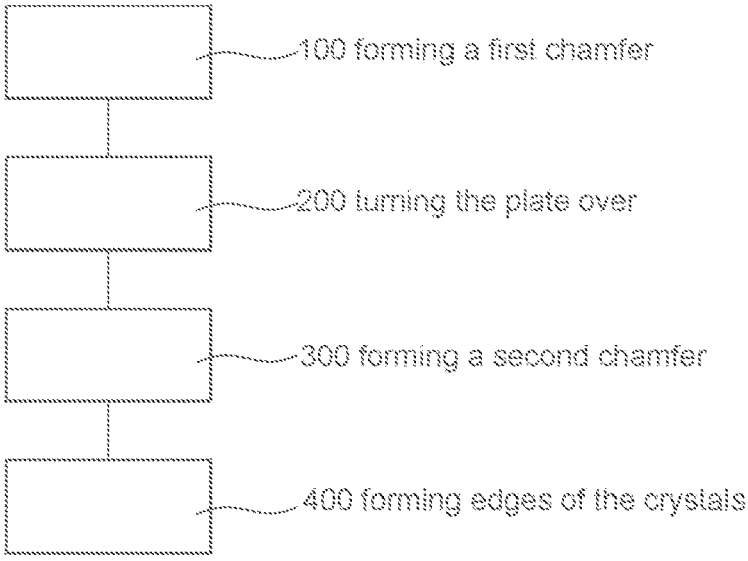
FIG. 10 is a block diagram illustrating the four essential steps of the method according to the invention.

More particularly, this at least one machined marking 14, and said at least one corresponding relief portion 16, each include a mutually complementary conical contact surface. This machined marking 14 may, in particular, be situated in an unused area that cannot be used for making crystals, such as a corner of plate 3, as seen in FIG. 9. It is also possible to improve positioning by machining a plurality of such machined markings 14, and advantageously with different diameters to perform the foolproofing function. Machined marking 14 can be a surface machined with the same tool as that used for chamfering, or a drilled hole or otherwise.

In a particular embodiment, during fourth step 400, crystals 1 are separated from a skeleton 13 by a machining operation along contour 2 performed by a laser or water jet cutting, or by plunge grinding if contour 2 is circular, with a grinding wheel 18 or a bell tool with a straight internal profile driven in rotation and plunged straight onto plate 3. Separation by laser is well suited, and not limited to, the case of sapphire crystals, or to that of crystals made of mineral glass.

In a particular embodiment, during first step 100 and/or third step 300, each cut line is machined with a grinding wheel which is regularly cooled in a sharpening station disposed in immediate proximity to plate 3.

In a particular embodiment, during first step 100 and/or third step 300, monitoring means, such as a camera or other optical means, are used to check the surface condition of each chamfer once it is made, and, when it is observed that a predefined roughness or transparency threshold has been breached, the grinding wheel or tool is changed, or the grinding wheel or tool is sharpened in a sharpening station disposed in immediate proximity to plate 3.

Preferably, the production unit includes control means which are arranged to control:

said monitoring means, the paths of the production means, management of the lifetime of the grinding wheels and/or tools, and the timing of sharpening, cycle interruptions and paths for performing sharpening, any tool change cycles when the production means include automatic tool magazines and changers, handling means especially automated means arranged to load plates 3 and turn them over, and to remove the finished crystals 1 and residual skeletons 13, lubrication and filtering if there is a return of lubricant to the production means.

Preferably, a panoply of crystals 1 are made from a same plate 3. More particularly, crystals 1 with different contours 2 are made from the same plate 3, to minimise scrap in skeleton 13, as seen in FIG. 9 where large elliptical crystals are found next to small round crystals.

In a particular embodiment, during first step 100 and/or third step 300, and/or fourth step 400, the work area is lubricated with air and/or a liquid fluid to evacuate machining waste. However, this lubrication function depends on the type of grinding wheel or tool used, and the particular operating instructions should be observed, especially for diamond grinding wheels or certain specific tools, in accordance with their sensitivity to thermal shock, or the need to operate in dry conditions, or otherwise.

In a particular embodiment, which also depends on the type of grinding wheels and/or tools implemented, during first step 100, and/or third step 300, and/or fourth step 400, plate 3 is immersed in a liquid fluid to which a current is imparted to remove machining waste.

The method according to the invention allows, in particular, to realize very thin crystals, because the chamfers are formed prior to cutting, for example a crystal of 0.5 mm thickness with 0.1 mm chamfers, which would be impossible to achieve using a conventional clamp holding arrangement.

More particularly, the parameters are as follows:

Tool shape: continuous bell;

Type of grinding wheel: metal bond diamond grinding wheel;

Rotational speed: 2,500 to 5,000 rpm;

Infeed speed: 3 mm/min +5/−1;

Lubrication: oil, through the centre;

Disposal of grinding waste: by centrifugation;

Maximum plunge depth in unprocessed plate: 0.5 mm;

Positioning: by pins;

Range of chamfering angles relative to the crystal axis: 35°+/−5°;

Range of residual chamfering values after laser cutting: 0.15 mm+/−50 um.

What is claimed is:

1. A method for cutting watch crystals along a plurality of contours in a plate of transparent material, comprising:

first step: forming on a first side of the plate, a first cut line or kerf on at least the inside of one of the contours, to form a first chamfer, for each of the crystals to be made from the plate, and making at least one machined recess on the first side of the plate;

second step: turning over the plate and marking at least one of the position of the first chamfer and the position of the at least one machined recess;

third step: forming on a second side of the plate, opposite to the first side, a second cut line or kerf on at least the inside of the one of the contours, to form a second chamfer, in alignment with the first cut line and the first chamfer, for each of the crystals to be made from the plate; and fourth step: separating the crystals from a skeleton of the plate by machining through the plate at each of the contours to form edges of the crystals.

2. The method according to claim 1, wherein, during at least one of the first step and the third step, there is used one of a grinding wheel and a bell tool whose profile corresponds to the first chamfer or the second chamfer to be formed, driven in rotation and plunged straight onto the plate, if the one of the contours is circular.

3. The method according to claim 1, wherein, during at least one of the first step and the third step, there is used one of a grinding wheel and a bell tool driven in rotation and effecting multi-axis contouring along the one of the contours, with the axis of rotation of one of the grinding wheel and the bell tool moving through space perpendicularly to a plane locally tangent to the first chamfer or the second chamfer to be formed.

4. The method according to claim 1, wherein, during at least one of the first step and the third step, there is used a shank boring tool mounted on a boring head, driven in rotation and plunged straight onto the plate, when the one of the contours is circular.

5. The method according to claim 1, wherein, during at least one of the first step and the third step, there is used a shank boring tool driven in rotation and effecting multi-axis contouring along the one of the contours, with the axis of rotation of a boring head carrying the shank boring tool moving through space perpendicularly to the plane locally tangent to the first chamfer or the second chamfer to be formed.

6. The method according to claim 1, wherein during the second step, the plate is placed on a tool including at least one relief portion arranged to cooperate with the at least one machined recess to position the plate in a unique position, and the plate is immobilized on the tool.

7. The method according to claim 6, wherein the at least one machined recess, and the at least one corresponding relief portion, each includes a mutually complementary conical contact surface.

8. The method according to claim 1, wherein, during the fourth step the crystals are separated from the skeleton by a machining operation along each of the contours performed one of by laser or water jet cutting, and by plunge grinding if each of the contours is circular, with one of a grinding wheel and a bell tool with a straight internal profile driven in rotation and plunged straight onto the plate.

9. The method according to claim 1, wherein, during at least one of the first step and the third step, the first cut line or the second cut line is machined with a grinding wheel which is cooled in a sharpening station disposed in immediate proximity to the plate.

10. The method according to claim 1, wherein, during at least one of the first step and the third step, a surface condition of the first chamfer or the second chamfer is checked once the first chamfer or the second chamfer is formed, and when one of a predefined roughness threshold and a transparency threshold has been breached, one of a grinding wheel and a tool is one of changed and sharpened in a sharpening station disposed in immediate proximity to the plate.

11. The method according to claim 1, wherein a plurality of the crystals is made from a same plate, and from the same plate, crystals with different contours are made to minimize waste of material in the skeleton.

12. The method according to claim 1, wherein, during at least one of the first step, the third step, and the fourth step, a work area is lubricated with at least one of air and a liquid to evacuate machining waste.

13. The method according to claim 1, wherein, during at least one of the first step, the third step, and the fourth step, the plate is immersed in a liquid fluid to which a current is imparted to evacuate machining waste.

* * * * *